United States Patent [19]

Ishikawa et al.

[11] Patent Number: 4,465,762

[45] Date of Patent: Aug. 14, 1984

[54] METHOD FOR COLOR DEVELOPING COLOR PHOTOGRAPHIC SILVER HALIDE LIGHT-SENSITIVE MATERIAL

[75] Inventors: Takatoshi Ishikawa; Takashi Nakamura; Kotaro Nakamura, all of Kanagawa, Japan

[73] Assignee: Fuji Photo Film Co., Ltd., Kanagawa, Japan

[21] Appl. No.: 354,420

[22] Filed: Mar. 3, 1982

[30] Foreign Application Priority Data

Mar. 3, 1981 [JP] Japan ..... 56-30338

[51] Int. Cl.[3] ..... G03C 7/16

[52] U.S. Cl. ..... 430/376; 430/380; 430/387; 430/448; 430/469; 430/487

[58] Field of Search ..... 430/380, 446, 448, 469, 430/487, 405, 566, 376, 387

[56] References Cited

U.S. PATENT DOCUMENTS

| | | | |
|---|---|---|---|
| 2,685,516 | 8/1954 | Wilson | 430/487 |
| 3,243,294 | 3/1966 | Barr | 430/226 |
| 3,261,685 | 7/1966 | DeHaes et al. | 430/448 |
| 3,597,203 | 8/1971 | Willems | 430/380 |
| 3,705,035 | 12/1972 | Vetter et al. | 430/380 |
| 3,804,624 | 4/1974 | Arai et al. | 430/448 |
| 4,155,763 | 5/1979 | Hasebe et al. | 430/469 |
| 4,189,319 | 2/1980 | Waxman | 430/380 |

*Primary Examiner*—J. Travis Brown

*Attorney, Agent, or Firm*—Sughrue, Mion, Zinn, Macpeak, and Seas

[57] ABSTRACT

A method for forming a color image comprising color developing a color photographic silver halide light-sensitive material containing at least one compound represented by formula (I)

(I)

wherein X is a hydrogen atom or an acetyl group, R is an aryl group, and each of $R_1$, $R_2$, $R_3$, and $R_4$ is a hydrogen atom, an alkyl group, or an aryl group, using a color developer containing a p-phenylenediamine-based and/or p-aminophenol-based color developing agent and without performing black-and-white development.

11 Claims, 1 Drawing Figure

METHOD FOR COLOR DEVELOPING COLOR PHOTOGRAPHIC SILVER HALIDE LIGHT-SENSITIVE MATERIAL

FIELD OF THE INVENTION

The present invention relates to a method for the formation of color images by color development. More particularly, it is concerned with a novel method for rapid processing of color photographic silver halide light-sensitive material containing therein a color coupler, which has reduced dependence on processing period and permits processing the light-sensitive material, for example, within 1 minute at 33° C.

BACKGROUND OF THE INVENTION

Various techniques have heretofore been used to shorten the time required for color development, i.e., to permit rapid color development. For example, a method has been widely used in which a penetrating agent, e.g., benzyl alcohol, is added to a color developer in order to permit rapid color development, since the penetration of a color developing agent into a light-sensitive material tends to be slow because of the poor hydrophilic nature of the color developing agent. In accordance with this method, however, sufficient coloration cannot be attained unless the color development processing is performed for at least 3 minutes at 33° C.

In addition, a method comprising increasing the pH of a color developer is known. This method, however, suffers from various disadvantages; for example, when the pH is increased to more than 10.5, the oxidation of a color developing agent is seriously accelerated; since there is no suitable buffer, changes in the pH easily occur, and stable photographic properties cannot be obtained; and dependence on the processing time is increased.

It is also known to raise the activity of a color developer by increasing the concentration of a color developing agent therein. In this method, however, problems arise in that the processing solution is comparatively high in cost since the color developing agent is very expensive, and that the color developing agent readily precipitates, making the processing solution instable. Thus this method is not suitable for practical use.

In order to accomplish color development rapidly, there is known a method in which a color developing agent is previously incorporated into a light-sensitive material. For example, U.S. Pat. No. 3,719,492 discloses a method in which a color developing agent is incorporated as a metal salt. In accordance with this method, however, the resulting light-sensitive material is poor in storage stability and may be fogged prior to use thereof, and, furthermore, fogging may readily occur during color development.

It is also known, as is described in U.S. Pat. No. 3,342,559 and *Research Disclosure,* No. 15159 (1976), that in order to inactivate the amine moiety of a color developing agent, it can be incorporated in the form of a Schiff base. In this method, however, color development can proceed only after the color developing agent is alkali-hydrolyzed, and the color development is rather retarded. In incorporating the color developing agent as such, problems arise in that an emulsion is fogged during the storage thereof since the color developing agent is unstable, and, furthermore, various problems are involved in effecting the processing since the film-forming property of the emulsion is decreased.

Furthermore, it is known, as described, for example, in L. F. A. Mason, *Photographic Processing Chemistry,* Focal Press, pp. 103–107 (1966), that a compound represented by formula (I) as described hereinafter can be added to a black-and-white developer containing a developer, e.g., hydroquinone, to accelerate development. Incorporation of such compounds into a light-sensitive material is described in British Pat. No. 767,704. In the British Patent, however, the compounds are incorporated into a black-and-white light-sensitive material or a reversal color photographic light-sensitive material, for the purpose of accelerating only black-and-white development, and it is not intended at all to accomplish color development within a short time, such as 1 minute.

Japanese Patent Application (OPI) No. 52422/78 (the term "OPI" as used herein refers to a "published unexamined Japanese patent application") discloses the incorporation of the compound of formula (I) as described hereinafter into a color photographic light-sensitive material which contains a 2-equivalent magenta coupler having an oxy type of organic split-off group at an active site, for the purpose of preventing a reduction in the sensitivity of the color photographic light-sensitive material in the unexposed state. In Japanese Patent Application (OPI) No. 52422/78, however, no consideration was given to performing a rapid processing within a period of 1.5 minutes or less. Furthermore, it has been found that when the above-noted 2-equivalent magenta coupler is used, the effects of the invention as described hereinafter cannot be obtained, and a reduction in the photographic properties of the light-sensitive material containing the coupler occurs with a lapse of time.

A method of color developing a color photographic light-sensitive material by the use of a color developer containing a compound falling within the scope of the definition of formula (I) as described hereinafter is also known as described in British Pat. No. 1,032,925. In this method, however, when the processing is performed under normal conditions, only black-and-white development proceeds, and almost no color image is obtained.

SUMMARY OF THE INVENTION

An object of the invention is to provide a method for the processing of color photographic silver halide light-sensitive material which is free from the above-described problems, has reduced dependence of photographic properties on processing time, and, furthermore, permits rapid color development.

Another object of the invention is to provide a method for the processing of color photographic silver halide light-sensitive material which is suitable for the rapid processing such that the time required for color development is not more than 1.5 minutes, and preferably not more than 1 minute.

It has now been found that the above objects are attained by color developing a color photographic silver halide light-sensitive material containing at least one compound represented by formula (I) as described hereinafter with a color developer containing a p-phenylenediamine-based and/or p-aminophenol-based color developing agent and without performing black-and-white development.

The present invention, therefore, is a method for forming a color image color developing a color photographic silver halide light-sensitive material containing at least one compound represented by formula (I)

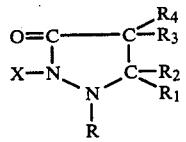

(I)

wherein X is a hydrogen atom or an acetyl group, R is an aryl group, and each of $R_1$, $R_2$, $R_3$, $R_4$ (which may be the same or different) is a hydrogen atom, an alkyl group, or an aryl group, using a color developer containing a p-phenylenediamine-based and/or p-aminophenol-based color developing agent without performing black-and-white development.

DETAILED DESCRIPTION OF THE INVENTION

Figure 1:
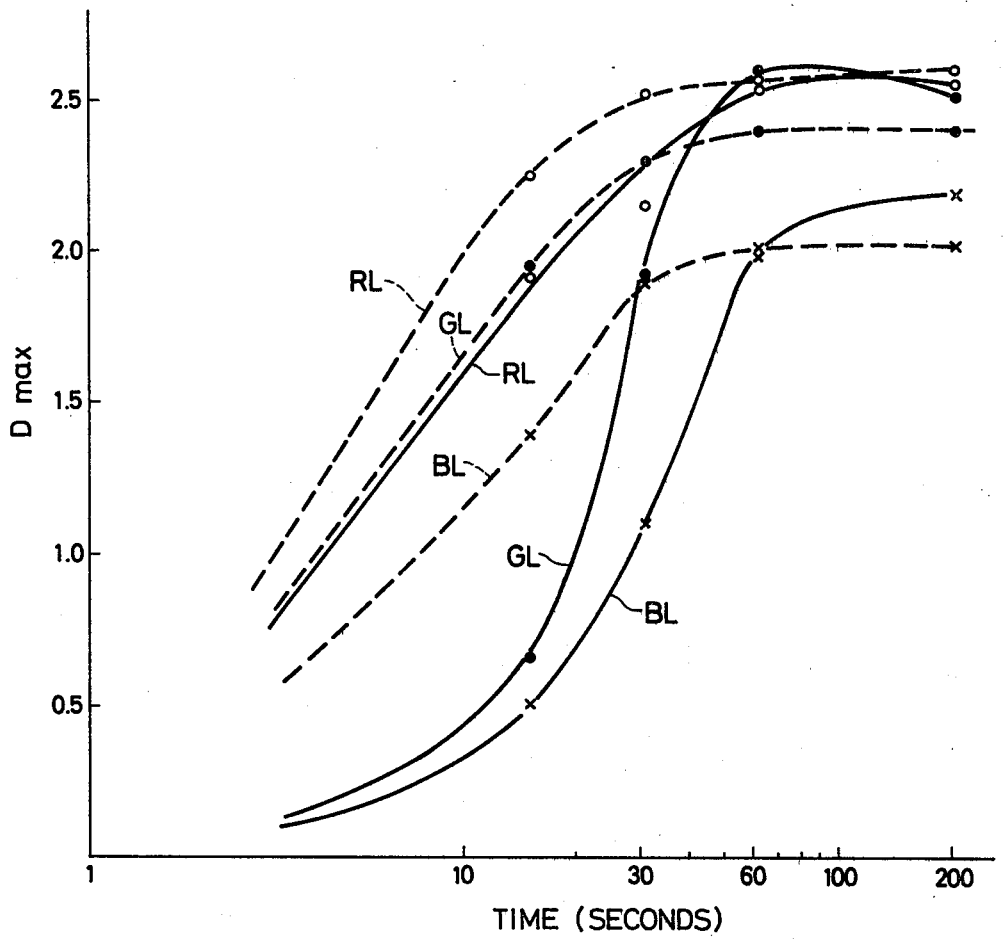
FIG. 1 shows the relation between the maximum density ($D_{max}$) of a color image and the processing time of color development for the light-sensitive materials prepared in Example 1.

In formula (I), the acetyl group represented by X may be substituted. For example, it may be an acetyl group substituted with an alkyl group, e.g., a methyl group and an ethyl group.

Examples of the aryl groups represented by R include a phenyl group, a naphthyl group, a tolyl group, and a xylyl group. These groups may be substituted by, for example, a halogen atom, such as a chlorine atom or a bromine atom, or an alkyl group, such as a methyl group, an ethyl group, and a propyl group.

The alkyl group represented by $R_1$, $R_2$, $R_3$, and $R_4$ is preferably an alkyl group containing from 1 to 10 carbon atoms, such as a methyl group, an ethyl group, a propyl group, and a butyl group. The alkyl group may be substituted by a hydroxyl group, an amino group, or the like. In addition, as the alkyl group, a phenyl group, a naphthyl group, a xylyl group, and a tolyl group can be used. These aryl groups may be substituted by a halogen atom, e.g., a chlorine atom or a bromine atom, or an alkyl group, e.g., a methyl group, an ethyl group, and a propyl group.

Of those groups represented by $R_1$, $R_2$, $R_3$, and $R_4$, a hydrogen atom, an alkyl group containing from 1 to 10 carbon atoms, and a substituted alkyl group containing from 1 to 10 carbon atoms are preferred. Particularly preferred are a hydrogen atom, a methyl group, and a hydroxymethyl group.

Of the compounds represented by formula (I), 3-pyrazolidones are preferably used in the invention. Examples of such pyrazolidones are listed below:

I-1: 1-Phenyl-3-pyrazolidone
I-2: 1-Phenyl-4,4-dimethyl-3-pyrazolidone
I-3: 1-Phenyl-2,4,4-trimethyl-3-pyrazolidone
I-4: 4-Hydroxymethyl-4-methyl-1-phenyl-3-pyrazolidone
I-5: 1-m-Tolyl-3-pyrazolidone
I-6: 1-p-Tolyl-3-pyrazolidone
I-7: 1-Phenyl-4-methyl-3-pyrazolidone
I-8: 1-Phenyl-5-methyl-3-pyrazolidone
I-9: 1-Phenyl-4,4-bis(hydroxymethyl)-3-pyrazolidone
I-10: 1,4-Dimethyl-3-pyrazolidone
I-11: 4-Methyl-3-pyrazolidone
I-12: 4,4-Dimethyl-3-pyrazolidone
I-13: 1-(3-Chlorophenyl)-4-methyl-3-pyrazolidone
I-14: 1-(3-Chlorophenyl)-3-pyrazolidone
I-15: 1-(4-Tolyl)-4-methyl-3-pyrazolidone
I-16: 1-(4-Tolyl)-3-pyrazolidone
I-17: 1-(2-Tolyl)-4-methyl-3-pyrazolidone
I-18: 1-(3-Tolyl)-3-pyrazolidone
I-19: 1-(3-Tolyl)-4,4-dimethyl-3-pyrazolidone
I-20: 1-(2-Trifluoroethyl)-4,4-dimethyl-3-pyrazolidone
I-21: 5-Methyl-3-pyrazolidone
I-22: 1,5-Diphenyl-3-pyrazolidone
I-23: 1-Phenyl-5,5-dimethyl-3-pyrazolidone
I-24: 1-Phenyl-5-carboxy-3-pyrazolidone
I-25: 1-(2-Tolyl)-4,4-bis(hydroxymethyl)-3-pyrazolidone
I-26: 1-(2-Chlorophenyl)-4-hydroxymethyl-4-methyl-3-pyrazolidone
I-27: 1-(3-Chlorophenyl)-4-hydroxymethyl-4-methyl-3-pyrazolidone
I-28: 1-(4-Chlorophenyl)-4-hydroxymethyl-4-methyl-3-pyrazolidone
I-29: 1-Phenyl-2-acetyl-3-pyrazolidone Of the compounds as set forth above, Compounds I-1, I-2, I-3, I-4, I-7, I-8, I-9, I-22, and I-23 are preferred for use in the invention.

The amount of the compound represented by formula (I) incorporated in the light-sensitive material is from 0.001 to 1 mol, and preferably from 0.005 to 0.5 mol, per mol of silver halide.

The compound (including combinations of compounds) of formula (I) may be incorporated into only one or two of the emulsion layers, i.e., a blue-sensitive layer, a green-sensitive layer, and a red-sensitive layer, or in all of the emulsion layers. Alternatively, it may be added to a layer adjacent to an emulsion layer. In general, it is preferred to incorporate the compound of formula (I) into a subbing layer or the lowermost emulsion layer adjacent to the subbing layer. With regard to a method of incorporation of the compound, it is preferred that the compound is dispersed directly in an emulsion, or after being dissolved in water or an alcohol, is dispersed in gelatin or an emulsion.

Any color photographic silver halide light-sensitive materials processed by color development without the performance of black-and-white development, such as a color paper, and a color negative film, can be used in the method of the invention. In particular, a print light-sensitive material is preferably used in the method of the invention.

The subbing layer for the photographic light-sensitive material as used herein is a hydrophilic colloid layer composed of a hydrophilic polymer, e.g., gelatin, and is usually provided by coating on a support in a thickness of 0.1μ to 100μ using a conventional process. As the hydrophilic polymer, binders for photographic emulsions as described hereinafter and protective colloids may be used. In general, by providing the subbing layer, the adhesion to the photographic emulsion to the base can be improved, and halation can be prevented.

The photographic emulsion layer for the photographic light-sensitive material of the invention contains a coupler capable of forming color by oxidative coupling with an aromatic primary amine developer (e.g., phenylenediamine derivatives or aminophenol derivatives) during color development processing. Magenta couplers, for example, which can be used in the invention include a cyanoacetyl cumarone coupler, an open chain acylacetonitrile coupler, and a 5-pyrazolone coupler and a pyrazolobenzimidazole coupler having the structure of formula (II) as shown below at the active site for coupling.

A—Y (II)

wherein A is a group containing an active coupling site for a 5-pyrazolone coupler or pyrazolobenzimidazole coupler, and Y is a hydrogen atom, —S—$R_5$, or

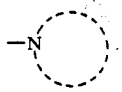

The symbol $R_5$ represents an alkyl group, an aryl group, or a heterocyclic group. The alkyl group represented by $R_5$ can be a straight or branched alkyl group containing from 1 to 32, and preferably from 1 to 22, carbon atoms. This alkyl group may be substituted.

The aryl group represented by $R_5$ contains from 6 to 36 carbon atoms, and examples thereof include a phenyl group and a naphthyl group. These groups may be substituted.

Examples of the heterocyclic groups represented by $R_5$ are set forth below:

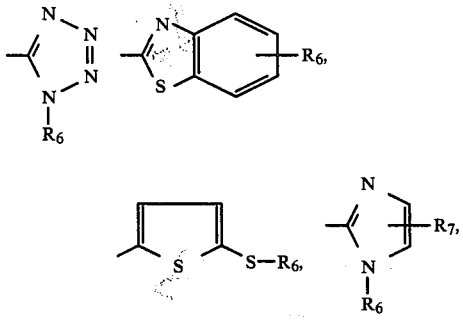

-continued

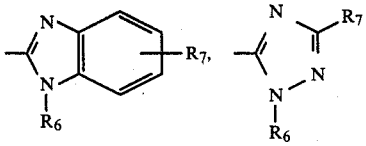

In the above formulae, each of $R_6$ and $R_7$ can be a hydrogen atom, an alkyl group containing from 1 to 22 carbon atoms, or an aryl group containing from 6 to 28 carbon atoms. These groups may be substituted. $R_6$ and $R_7$ may be the same or different.

The symbol

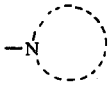

indicates a heterocyclic ring containing nitrogen, which may be substituted. Examples are shown below:

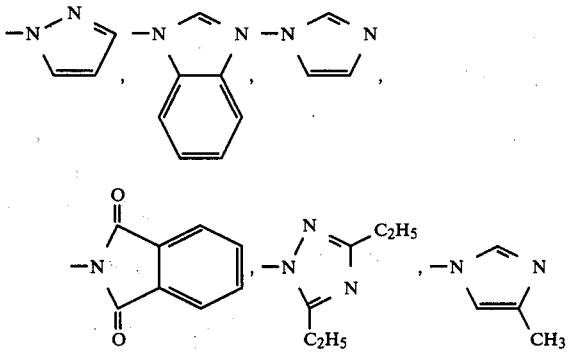

Of the groups represented by Y, a hydrogen atom and —S—$R_5$ are particularly preferred. With 2-equivalent magenta couplers containing as a univalent organic split-off group —O—$R_5$, the effects of the invention cannot be obtained.

Typical examples of magenta couplers are shown below:

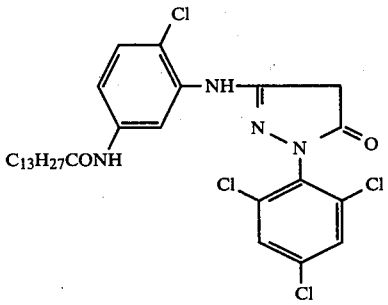

(M-1)

-continued
(M-2)
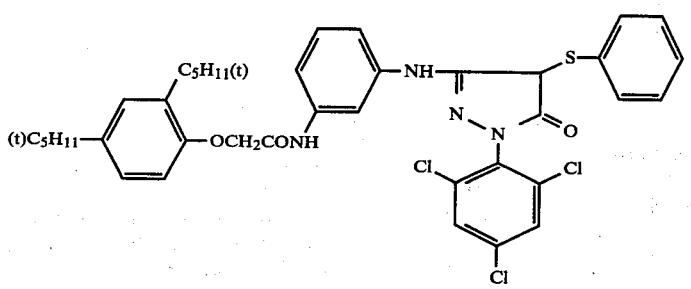
(M-3)
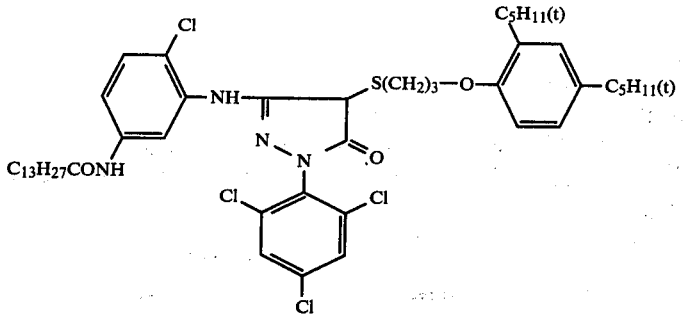
(M-4)
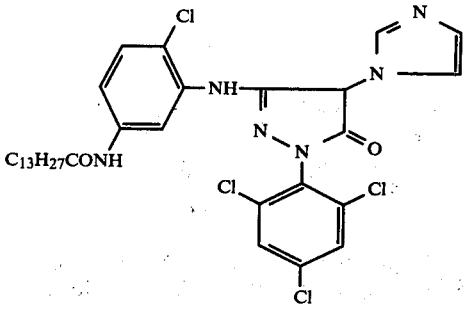
(M-5)
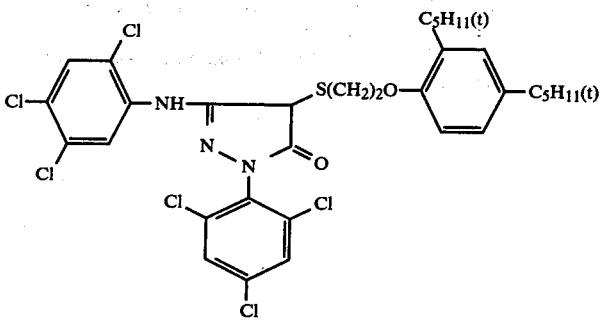
(M-6)
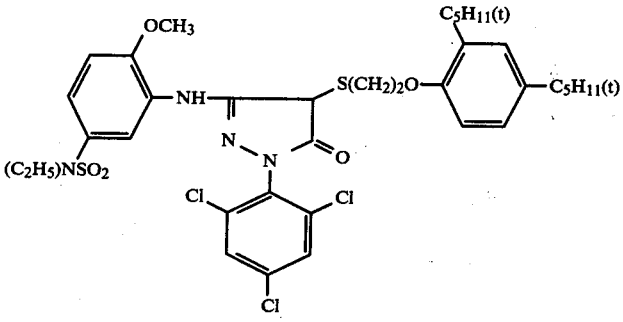

-continued
(M-7)
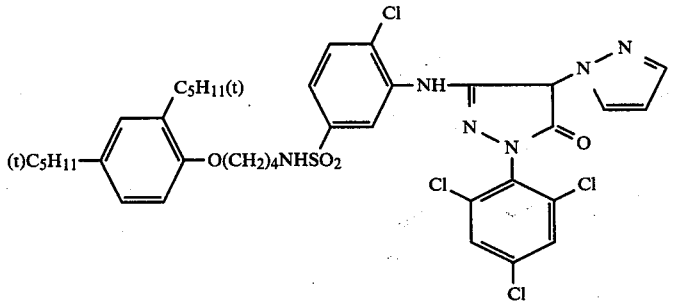
(M-8)
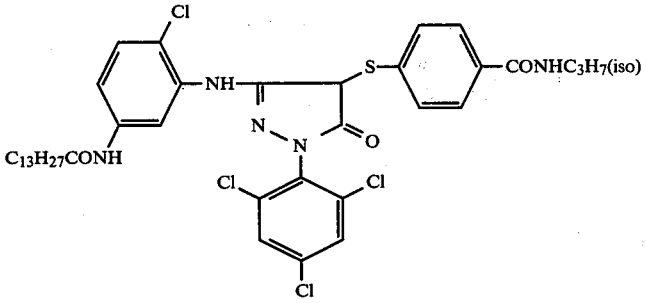
(M-9)
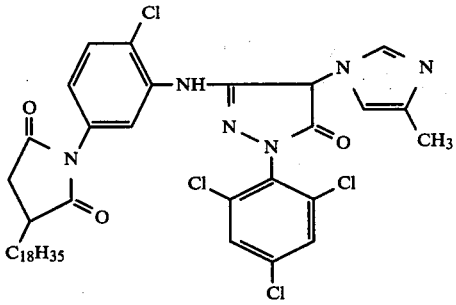
(M-10)
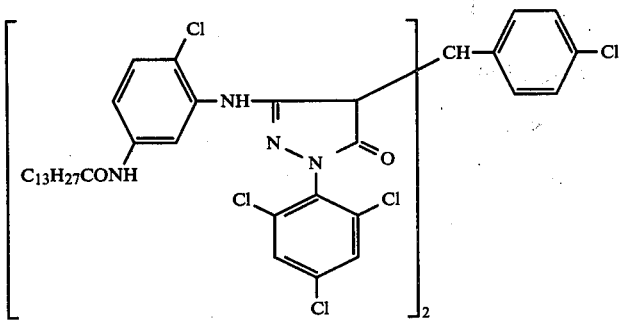
(M-11)
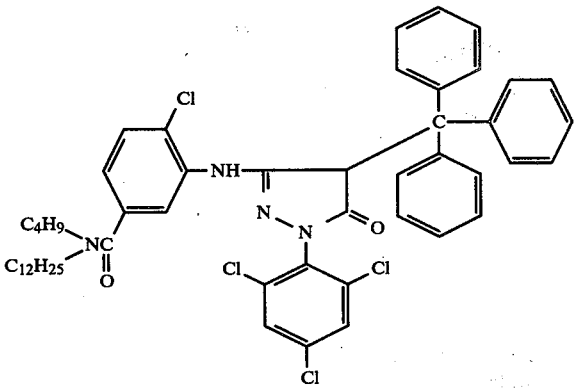

-continued
(M-12)
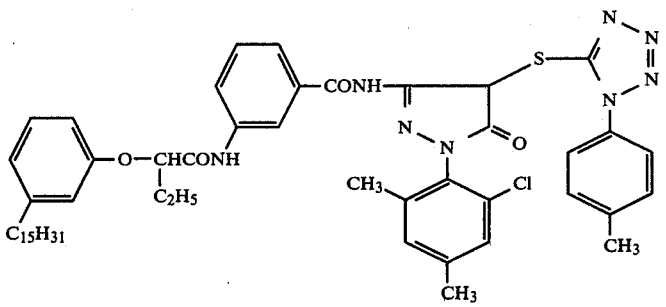
(M-13)
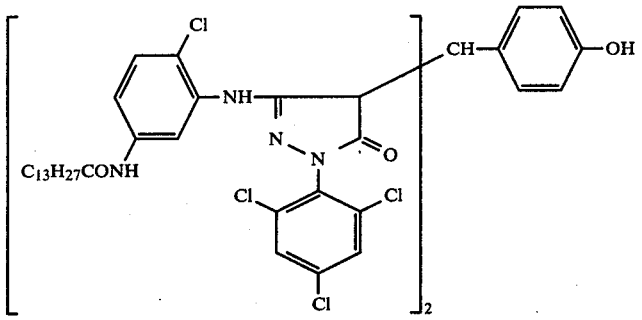
(M-14)
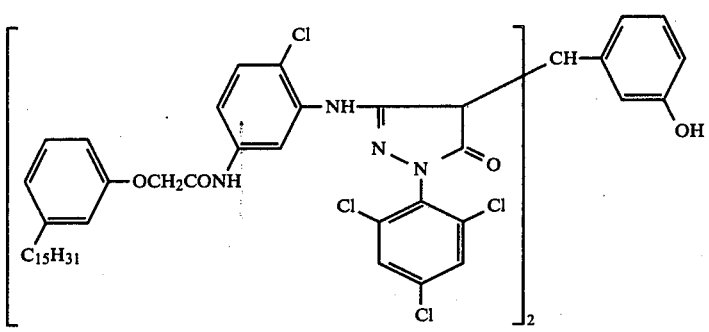
(M-15)
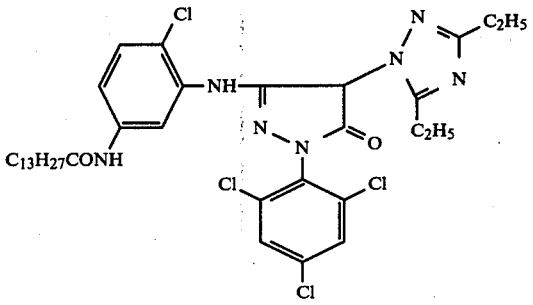
(M-16)
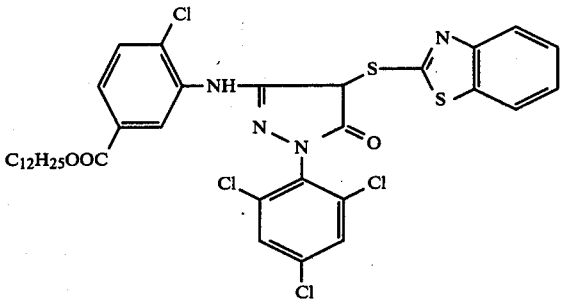
Preferred examples of yellow couplers which can be used in the invention include an acylacetamide coupler

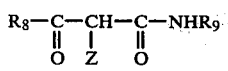

(III)

wherein Z is a hydrogen atom, a halogen atom, —S—$R_5$, or

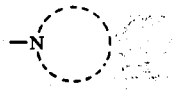

(wherein $R_5$ is the same as defined for formula (II), and

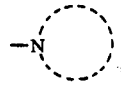

is a nitrogen-containing heterocyclic ring), $R_8$ is an aliphatic group, an aromatic group, or a heterocyclic ring, and $R_9$ is an aromatic group or a heterocyclic ring; with 2-equivalent couplers being more preferred for attaining the effects of the invention.

The aliphatic group represented by $R_8$ preferably contains from 1 to 22 carbon atoms, and may be in any of substituted or unsubstituted chain-like and cyclic forms. Preferred examples of substituents for the alkyl group include an alkoxy group, an aryloxy group, an amino group, and an acylamino group, and these substituent groups may also be substituted. Useful examples of the aliphatic groups represented by $R_8$ include an isopropyl group, an isobutyl group, a tert-butyl group, an isoamyl group, a tert-amyl group, a 1,1-dimethylbutyl group, a 1,1-dimethylhexyl group, a 1,1-diethylhexyl group, a dodecyl group, a hexadecyl group, an octadecyl group, a cyclohexyl group, a 2-methoxyisopropyl group, a 2-phenoxyisopropyl group, a 2-p-tert-butylphenoxyisopropyl group, an α-aminoisopropyl group, an α-(diethylamino)isopropyl group, an α-(succinimido)isopropyl group, an α-(phthalimido)isopropyl group, and an α-(benzenesulfonamido)isopropyl group.

Where $R_8$ or $R_9$ represents an aromatic group, particularly a phenyl group, the aromatic group may be substituted. Substituents contain 32 or less carbon atoms, and include an alkyl group, an alkenyl group, an alkoxy group, an alkoxycarbonyl group, an alkoxycarbonylamino group, an aliphatic amido group, an alkylsulfamoyl group, an alkylsulfonamido group, an alkylureido group, and an alkyl-substituted succinimido group. In the case of an alkyl group, it may contain an aromatic group, e.g., phenylene, in the chain thereof. The phenyl group may be further substituted by an aryloxy group, an aryloxycarbonyl group, an arylcarbamoyl group, an arylamido group, an arylsulfamoyl group, an arylsulfonamido group, an arylureido group or the like. The aryl moiety of these substituents may be further substituted by one or more alkyl group having a total number of carbon atoms of from 1 to 22.

The phenyl group represented by $R_8$ or $R_9$ may be further substituted by an amino group, a hydroxy group, a carboxy group, a nitro group, a cyano group, a thiocyano group, or a halogen atom, including those substituted by a lower alkyl group containing from 1 to 6 carbon atoms.

In addition, $R_8$ or $R_9$ may be a substituent resulting from condensation of a phenyl group to another ring, such as a naphthyl group, a quinoline group, an isoquinolyl group, a chromanyl group, a coumaranyl group, and a tetrahydronaphthyl group. These substituents may also be substituted.

Where $R_8$ or $R_9$ represents a heterocyclic group, the heterocyclic group is linked to a carbon atom of the carbonyl group of the acyl group or to a nitrogen atom of the amido group for α-acylacetamide through one of the carbon atoms constituting the ring thereof. Examples of such heterocyclic rings include thiophene, furan, pyran, pyrrole, pyrazole, pyridine, pyrazine, pyrimidine, pyridazine, indolizine, imidazole, thiazole, oxazole, triazine, and oxazine. These heterocyclic rings may be further substituted on the ring thereof.

Representative examples of yellow couplers are shown below:

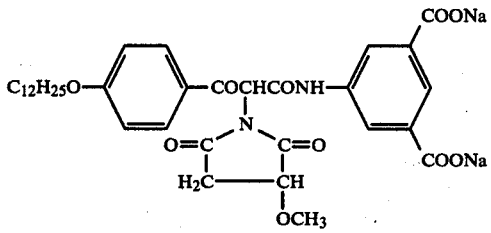

(Y-1)

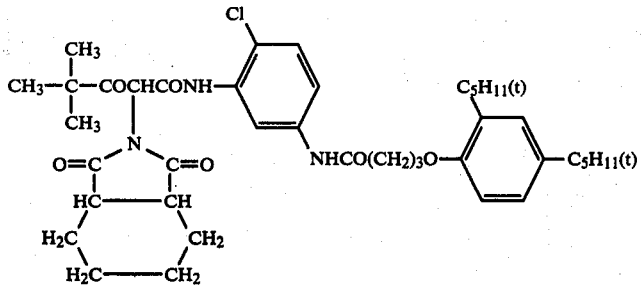

(Y-2)

-continued
(Y-3)
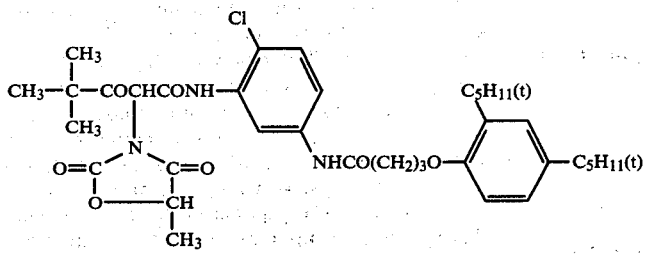
(Y-4)
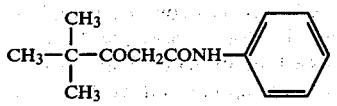
(Y-5)
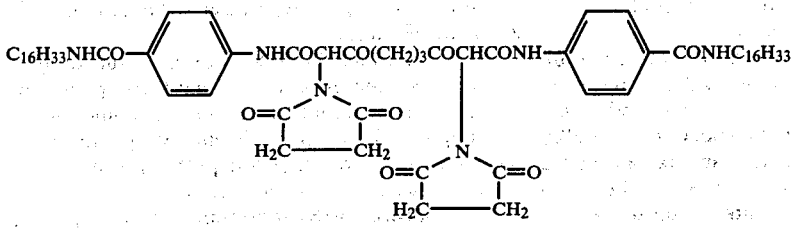
(Y-6)
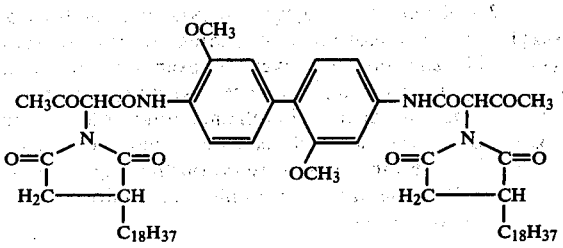
(Y-7)
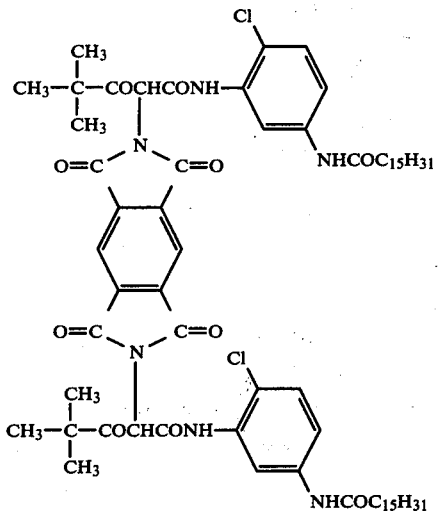

-continued
(Y-8)
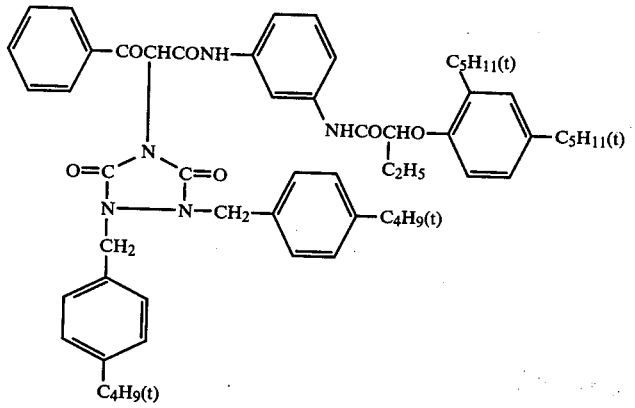
(Y-9)
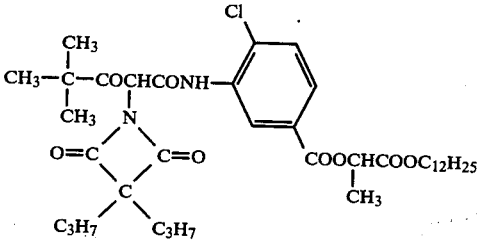
(Y-10)
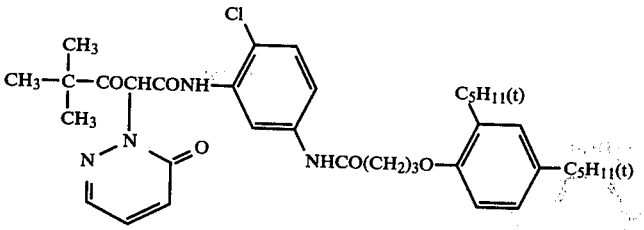
(Y-11)
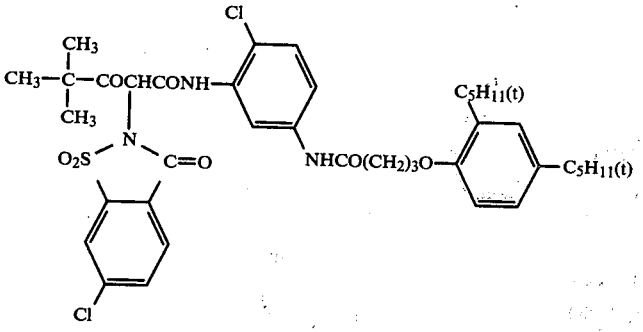
(Y-12)
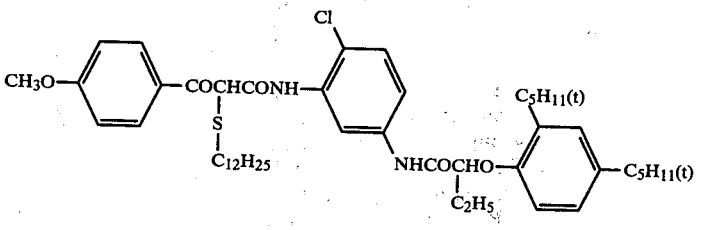

-continued (Y-13)

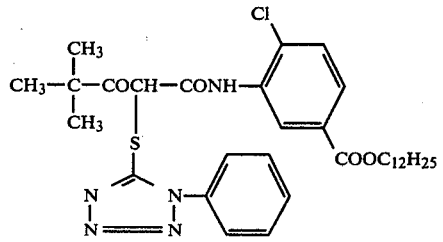

(Y-14)

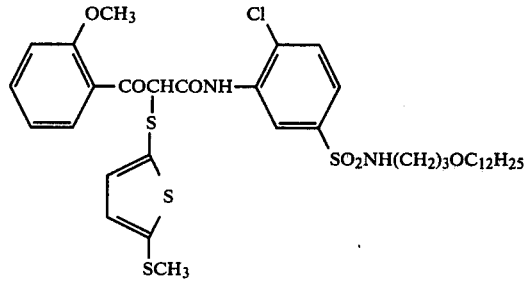

(Y-15)

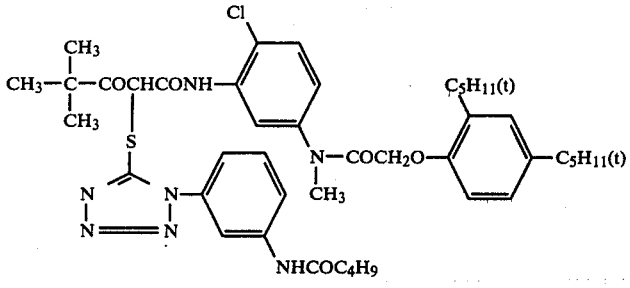

(Y-16)

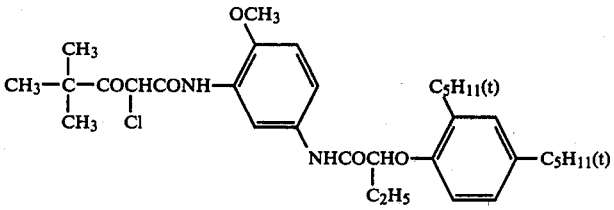

(Y-17)

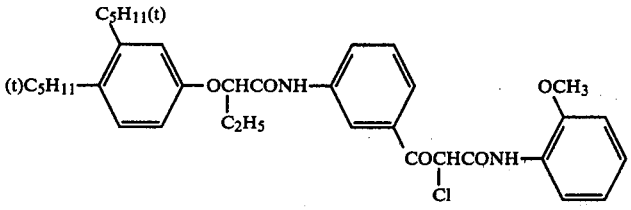

Preferred examples of cyan couplers as used herein include a phenol type coupler and a naphthol type coupler. In particular, the cyan couplers represented by formulae (IV) and (V) are preferred.

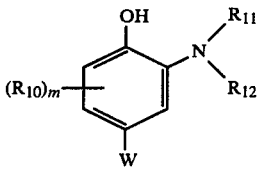

(IV)

and

-continued

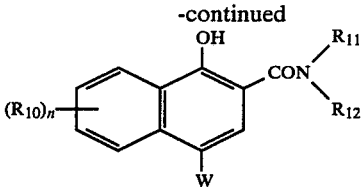

(V)

In the above formulae, W represents a hydrogen atom, a halogen atom, —S—$R_5$, or an oxy-releasing group, wherein $R_5$ is the same as defined in formula (II). Examples of such oxy-releasing groups include acyloxy, alkoxy, aryloxy, alkoxycarbonyloxy, and sulfonyloxy.

$R_{10}$, $R_{11}$, and $R_{12}$ represent groups as used in the usual 4-equivalent phenol or α-naphthol couplers. In more detail, $R_{10}$ represents, for example, a hydrogen atom, a halogen atom, an aliphatic hydrocarbon radical, an acylamino group, a group —O—$R_{13}$ or a group —S—$R_{13}$ (wherein $R_{13}$ is an aliphatic hydrocarbon radical). Where there are two or more groups of $R_{10}$, the groups may be different. The aliphatic hydrocarbon radical may be substituted. Examples of the groups represented by $R_{11}$ and $R_{12}$ include an aliphatic hydrocarbon radical, an aryl group, and a heterocyclic radical. One of $R_{11}$ and $R_{12}$ may be a hydrogen atom. The groups constituting $R_{11}$ and $R_{12}$ may be substituted. Furthermore, $R_{11}$ and $R_{12}$ may combine together to form a a nitrogen-containing heterocyclic nucleus.

In the above formulae, m is an integer of from 1 to 3, and n is an integer of from 1 to 5.

The aliphatic hydrocarbon radical represented by $R_{10}$, $R_{11}$ or $R_{12}$ may be either saturated or unsaturated, and furthermore, may be either straight or branched or cyclic. Preferred examples are an alkyl group, e.g., methyl, ethyl, propyl, isopropyl, butyl, tert-butyl, isobutyl, dodecyl, octadecyl, cyclobutyl, and cyclohexyl, and an alkenyl group, e.g., allyl and octenyl.

The aryl group includes a phenyl group and a naphthyl group. The heterocyclic radical includes pyridyl, quinolyl, thienyl, piperidyl, and imidazolyl.

Substituents that can be introduced onto the aliphatic hydrocarbon radical, the aryl group, and the heterocyclic radical include a halogen atom, a nitro group, a hydroxy group, a carboxyl group, an amino group, a substituted amino group, a sulfo group, an alkyl group, an alkenyl group, an aryl group, a heterocyclic group, an alkoxy group, an aryloxy group, an arylthio group, an arylazo group, an acylamino group, a carbamoyl group, an ester group, an acyl group, an acyloxy group, a sulfonamido group, a sulfamoyl group, a sulfonyl group, and a morpholino group.

Representative examples of cyan couplers as used herein are shown below:

(C-1)

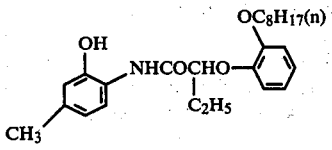

(C-2)

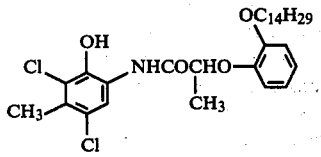

(C-3)

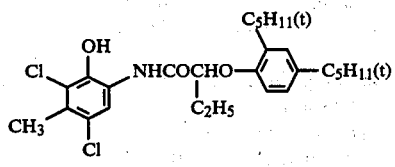

(C-4)

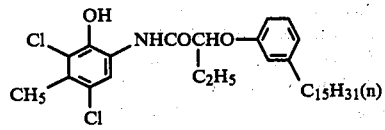

-continued (C-5)

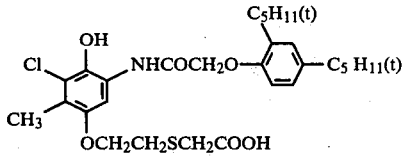

(C-6)

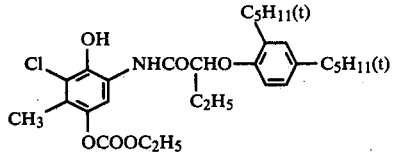

(C-7)

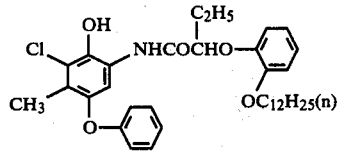

(C-8)

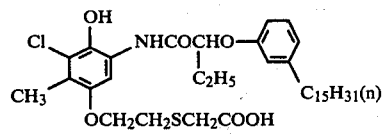

(C-9)

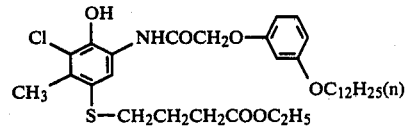

(C-10)

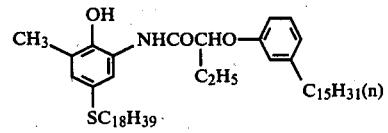

(C-11)

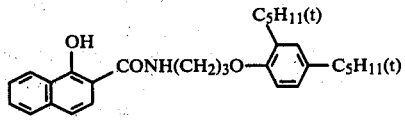

(C-12)

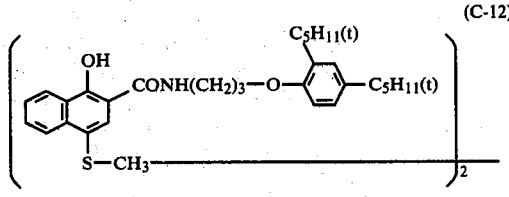

(C-13)

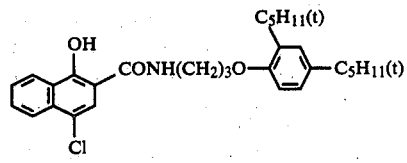

(C-14)

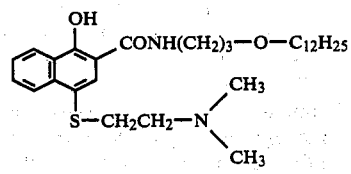

-continued (C-15)

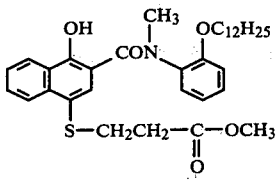

(C-16)

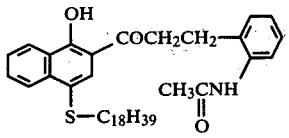

(C-17)

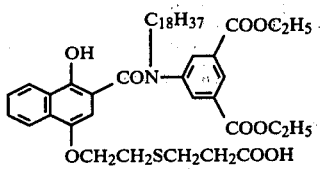

(C-18)

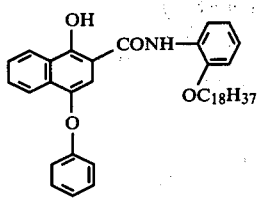

(C-19)

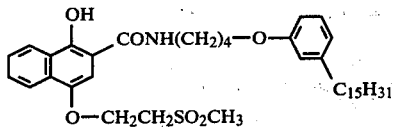

In addition to the above-described couplers, colored couplers having the effect of color correction or couplers releasing a development inhibitor (so-called DIR couplers) as development proceeds can be used. Moreover, colorless DIR coupling compounds producing a colorless coupling reaction product and releasing a development inhibitor may be incorporated.

Colored couplers which can be used are described, for example, in U.S. Pat. Nos. 3,476,560, 2,521,908, 3,034,892, Japanese Patent Publication Nos. 2016/69, 22335/63, 11304/67, 32461/69, Japanese Patent Application (OPI) Nos. 26034/76, 42121/77 (the term "OPI" as used herein refers to a "published unexamined Japanese patent application"), and West German Patent Application (OLS) No. 2,418,959.

DIR couplers which can be used are described, for example, in U.S. Pat. Nos. 3,227,554, 3,617,291, 3,701,783, 3,790,384, 3,632,345, West German Patent Application (OLS) Nos. 2,414,006, 2,454,301, 2,454,329, British Pat. No. 953,454, Japanese Patent Application (OPI) Nos. 69624/77, 122335/74, and Japanese Patent Publication No. 16141/76.

Colorless DIR coupling compounds which can be used are described, for example, in U.S. Pat. Nos. 3,297,445, 3,379,529, West German Patent Application (OLS) No. 2,417,914, and Japanese Patent Application (OPI) Nos. 15271/77, 9116/78, etc.

As the silver halide for use in the photographic emulsion layer of the photographic light-sensitive material as used herein, any of silver bromide, silver iodobromide, silver iodochlorobromide, silver chlorobromide, and silver chloride can be used.

Photographic emulsions as used herein can be prepared by the method described, for example, in P. Glafkides, *Chimie et Physique Photographique,* Paul Montel (1967), C. F. Duffin, *Photographic Emulsion Chemistry,* The Focal Press (1966), and V. L. Zelikman et al., *Making and Coating Photographic Emulsion,* The Focal Press (1964). Any one of an acid method, a neutral method, an ammonia method, and so forth can be used. As a method of reacting a soluble silver salt and a soluble halogen salt, any of a single jet mixing method, a simultaneous mixing method, and a combination thereof can be used.

In addition, a method of forming grains in the presence of an excessive amount of silver ion (the so-called reversal mixing method) can be used. As one procedure of the simultaneous mixing method, a method in which the pAg of a liquid phase where silver halide is formed is controlled, i.e., the so-called controlled double jet method can be used.

It is advantageous to use gelatin as a binder or a protective colloid for the photographic emulsion, but other hydrophilic colloids can be used.

Hydrophilic colloids which can be used include proteins, such as gelatin derivatives, graft polymers of gelatin and other polymers, albumin, and casein; sugar derivatives, such as cellulose derivatives, e.g., hydroxyethyl cellulose, carboxymethyl cellulose, and cellulose sulfuric acid esters, sodium alginate, and starch derivatives; and a variety of synthetic hydrophilic polymeric substances, such as polyvinyl alcohol, partial acetal of polyvinyl alcohol, poly-N-vinyl pyrrolidone, polyacrylic acid, polymethacrylic acid, polyacrylamide, polyvinyl imidazole, polyvinyl pyrazole.

As the gelatin, acid-treated gelatin and enzyme-treated gelatin as described in *Bull. Soc. Sci. Photo. Japan,* No. 16, page 30 (1966) as well as lime-treated gelatin can be used. Furthermore, hydrolysis products and enzyme decomposition products of gelatin can be used. Gelatin derivatives which can be used include the reaction products of gelatin and various compounds, such as acid halides, acid anhydrides, isocyanates, bromoacetic acid, alkanesultones, vinylsulfonamides, maleinimido compounds, polyalkylene oxides, and epoxy compounds.

The photographic emulsion as used herein may be spectrally sensitized, for example, with methine dyes. Sensitizing dyes as used for the spectral sensitization may be used alone or in combination with each other. Combinations of sensitizing dyes are often used, particularly for the purpose of supersensitization. In combination with such sensitizing dyes, dyes which per se do not have spectral sensitizing action or substances substantially not absorbing visible light may be incorporated in the emulsion as long as they exhibit supersensitization.

Useful sensitizing dyes, combinations of dyes exhibiting supersensitization, and substances exhibiting supersensitization are described in *Research Disclosure,* Vol. 176, 17643 (published December 1978), page 23, IV-J.

The photographic light-sensitive materials as used herein may contain a water-soluble dye in the hydrophilic colloid layer thereof as a filter dye, or for various purposes including preventing irradiation and so forth. Such dyes include oxonol dyes, hemioxonol dyes, styryl dyes, merocyanine dyes, cyanine dyes, and azo dyes. Of these compounds, oxonol dyes, hemioxonol dyes and merocyanine dyes are useful.

The photographic light-sensitive material as used herein may contain, as an anti-color-foggant, a hydroquinone derivative, an aminophenol derivative, a gallic acid derivative, an ascorbic acid derivative, or the like.

In the photographic light-sensitive material as used herein, when dye, an ultraviolet ray absorber, or like compounds are incorporated into the hydrophilic colloid layer, they may be mordanted with cationic polymers and so forth.

The photographic light-sensitive material as used herein may contain an inorganic or organic hardener in the photographic emulsion layer and other hydrophilic colloid layers thereof. Examples of hardeners which can be used include chromium salts, e.g., chromium alum and chromium acetate, aldehydes, e.g., formaldehyde, glyoxal, and glutaraldehyde, N-methylol compounds, e.g., dimethylol urea and methyloldimethylhydantoin, dioxane derivatives, e.g., 2,3-dihydroxydioxane, active vinyl compounds, e.g., 1,3,5-triacryloyl-hexahydro-s-triazine and 1,3-vinylsulfonyl-2-propanol, active halogeno compounds, e.g., 2,4-dichloro-6-hydroxy-s-triazine, and mucohalogenic acids, e.g., mucochloric acid, and mucophenoxychloric acid. These compounds can be used alone or in combination with each other.

In the practice of the method of the invention, known discoloration-preventing agents can be used, alone or in combination, and color image stabilizers as used herein can be used alone or as mixtures comprising two or more thereof. Known discoloration-preventing agents include hydroquinone derivatives, gallic acid derivatives, p-alkoxyphenols, p-oxyphenol derivatives, and bisphenols.

In the preparation of the photographic light-sensitive material as used herein, the photographic emulsion layer and other layers are coated on a flexible support, e.g., a plastic film, paper and cloth, or a stiff support, e.g., glass, porcelain, and metal. Useful examples of flexible supports include films made of semisynthetic or synthetic polymers such as cellulose nitrate, cellulose acetate, cellulose acetate butyrate, polystyrene, polyvinyl chloride, polyethylene terephthalate, and polycarbonate, paper provided with a baryta layer or a layer of $\alpha$-olefin polymer (e.g., polyethylene, polypropylene, and an ethylene-butene copolymer) by coating or laminating, and so forth. The support may be colored with dye or pigment. For example, it may be made black for the purpose of light-shielding. In general, the surface of the support is subjected to a subbing treatment in order to improve the adhesion to the photographic emulsion layer. Either before or after the subbing treatment, the surface of the support may be subjected to treatments such as corona-discharge, irradiation with ultraviolet rays, and treatment with flame.

The method of the invention can be applied to integral multicolor photographic material having at least two different spectral sensitivities on the support thereof. Integral natural color photographic material usually comprises a support, and at least one layer each of red-sensitive, green-sensitive, and blue-sensitive emulsion layers. The order in which the layers are provided on the support is not critical, and can be chosen appropriately. For natural color reproduction, usually the red-sensitive emulsion layer contains a cyan-forming coupler, the green-sensitive emulsion layer contains a magenta-forming coupler, and the blue-sensitive emulsion layer contains a yellow-forming coupler. In some cases, other combinations can be employed.

In the preparation of the color photographic light-sensitive material as used herein, the photographic emulsion layer and other hydrophilic colloid layers can be coated on the support or other layers by various known coating techniques, such as a dip coating method, a roll coating method, a curtain coating method, and an extrusion coating method. The methods described in U.S. Pat. Nos. 2,681,294, 2,761,791 and 3,526,528 can be used advantageously.

In photographic processing of the color photographic light-sensitive material of the invention known processing solution can be used. The processing temperature is ordinarily from 18° to 50° C., but may be lower than 18° C. or higher than 50° C. Any color photographic processing solution containing a p-phenylenediamine-based and/or p-aminophenol-based color developing agent can be used.

The color developer for use in the method of the invention is generally an alkaline aqueous solution containing a p-phenylenediamine-based and/or p-aminophenol-based color developing agent. p-Phenylenediamine-based and/or p-aminophenol-based color developing agents which can be used include known primary aromatic amine developers, such as phenylenediamines, e.g., 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfonamidoethylaniline, and 4-amino-3-methyl-N-ethyl-N-$\beta$-methoxyethylaniline. In addition, the compounds described, for example, in L. F. A. Mason, *Photographic Processing Chemistry,* Focal Press, pp. 226 to 229 (1966), U.S. Pat. Nos. 2,193,015, 2,592,364, and Japanese Patent Application (OPI) No. 64933/73 can be used.

Although color developing agents such as p-phenylenediamine-based and/or p-aminophenol-based developer may be incorporated into color photographic silver halide light-sensitive material, it is more preferred not to incorporate them into the light-sensitive material. When the p-phenylenediamine-based and/or p-aminophenol-based developer is incorporated into the color developer, the amount of the p-phenylenediamine-based and/or p-aminophenol-based developer added is preferably from 1 to 12 g/liter.

The color developer can contain a pH buffer, e.g., a sulfurous acid, carbonic acid, boric acid or boric acid salt of an alkali metal, a development inhibitor or anti-foggant, e.g., a bromide, iodide, or an organic anti-foggant, and so forth. If necessary, a hard water-softening agent, a preservative, e.g., hydroxyamine, an organic solvent, e.g., benzyl alcohol or diethylene glycol, a development accelerator, e.g., ethylene glycol, a quaternary ammonium salt, or an amine, a dye-forming coupler, a competing coupler, a foggant, e.g., sodium borohydride, a tackifier, a polycarboxylic acid-based chelating agent described in U.S. Pat. No. 4,083,723, an antioxidant described in West German Patent Application (OLS) No. 2,622,950, and so forth may be incorporated.

The photographic emulsion layer after color development is usually bleached. The bleach treatment may be performed either simultaneously with a fixing treatment or separately therefrom. Bleaching agents which can be used include polyvalent metal (e.g., iron (III), cobalt (III), chromium (VI), and copper (II)) compounds, peracids, quinones, and nitroso compounds. Examples are ferricyanide, dichromic acid salts, organic complex salts of iron (III) and cobalt (III), e.g., complex salts of aminopolycarboxylic acids, such as ethylenediaminetetraacetic acid, nitrilotriacetic acid, and 1,3-diamino-2-propanoltetraacetic acid, or organic acids, such as citric acid, tartaric acid, and malic acid, persulfuric acid salts, permanganic acid salts, and nitrosophenol. Of these compounds, potassium ferricyanide, iron (III) sodium ethylenediaminetetraacetate, and iron (III) ammonium ethylenediaminetetraacetate are particularly useful. Ethylenediaminetetraacetic acid iron (III) complex salts are useful both for an independent bleaching solution or for a combined bleaching and fixing solution.

To the bleaching or bleach-fixing solution there can be added bleach accelerators as described, for example, in U.S. Pat. Nos. 3,042,520, 3,241,966, Japanese Patent Publication Nos. 8506/70, 8836/70, thiol compounds described in Japanese Patent Application (OPI) No. 65732/78, and other various additives.

The color photographic light-sensitive material may be processed with a developer which is supplemented or stored by the methods described in Japanese Patent Application (OPI) Nos. 84636/76, 119934/77, 46732/78, 9626/79, 19741/79, 37731/79, 1049/81 and 27142/81 and U.S. Pat. No. 431,808.

The bleach-fixing solution as used in the processing of the light-sensitive material may be the one regenerated by the methods described in Japanese Patent Application Nos. 781/71, 49437/73, 18191/73, 145231/75, 18541/76, 19535/76, 144620/76, and Japanese Patent Publication No. 23178/76.

The following examples are provided to illustrate the invention in greater detail.

EXAMPLE 1

A light-sensitive material was prepared by coating a polyethylene-laminated paper support, in the order listed, with:

(1) a dispersion prepared by dispersing an ethanol solution of Compound I-4 in gelatin (gelatin: 1 g/m$^2$; Compound I-4: 100 mg/m$^2$);

(2) a dispersion prepared by dispersing Yellow Coupler (Y-3) dissolved in dioctylbutyl phosphate in a silver chlorobromide emulsion (silver bromide, 80 mol%) (silver: 0.4 g/m$^2$; coupler: $8\times10^{-4}$ mol/m$^2$; oil for coupler (dioctyl butyl phosphate): 0.3 g/m$^2$);

(3) a gelatin intermediate layer (gelatin: 1 g/m$^2$);

(4) an emulsion prepared by emulsifying Magenta Coupler (M-1) dissolved in tricresyl phosphate in a silver chlorobromide emulsion (silver bromide, 60 mol%) (silver: 0.23 g/m$^2$; coupler: $5.8\times10^{-4}$ mol/m$^2$; oil for coupler (tricresyl phosphate): 0.35 g/m$^2$);

(5) a gelatin intermediate layer containing a solvent (gelatin: 1.2 g/m$^2$; dibutyl phthalate: 0.25 g/m$^2$; 2-(2-hydroxy-3-sec-butyl-5-tert-butylphenyl)benzotriazole: 1 g/m$^2$);

(6) an emulsion prepared by emulsifying Cyan Coupler (C-13) dissolved in dibutyl phthalate in a silver chlorobromide emulsion (silver bromide, 50 mol%) (silver: 0.3 g/m$^2$; coupler: $8.5\times10^{-4}$ mol/m$^2$; oil for coupler (dibutyl phthalate): 0.2 g/m$^2$); and (7) a gelatin protective layer (gelatin: 1 g/m$^2$).

In addition, a light-sensitive material was prepared in the same manner as above except that Compound I-4 was not incorporated therein.

Each light-sensitive material was exposed to light through an optical wedge and was processed according to the following steps:

| | | |
|---|---|---|
| Color Development | 33° C. | 0.25 to 3.5 min |
| Bleach-Fixation | " | 1.5 min |
| Water-Washing | " | 2 min |
| Drying | " | 10 min |

The composition of each processing solution is set forth below:

| | |
|---|---|
| Color Developer | |
| Benzyl alcohol | 10 ml |
| Diethylene glycol | 3 ml |
| Potassium carbonate | 25 g |
| Sodium chloride | 0.1 g |
| Sodium bromide | 0.5 g |
| Anhydrous sodium sulfite | 2 g |
| Hydroxyamine sulfuric acid salt | 2 g |
| N—Ethyl-N—β-methanesulfonamidoethyl-3-methyl-4-aminoaniline sulfuric acid salt | 4 g |
| Water to make | 1 l |
| Sodium hydroxide (NaOH) was added to adjust the pH to 10. | |
| Bleach-Fixing Solution | |
| Ammonium thiosulfate | 124.5 g |
| Sodium metabisulfite | 13.3 g |
| Anhydrous sodium sulfite | 2.7 g |
| EDTA ferric ammonium salt | 65 g |
| Color developer (as described above) | 100 ml |
| After adjustment of pH to 6.7 to 6.8 | |
| Water to make | 1 l |

The reflection density for each of yellow, magenta and cyan was measured using a Macbeth densitometer.

The maximum density was plotted against the logarithmic value of the processing period (0.25 min, 0.5 min, 1 min, and 3.5 min) with the color developer, as shown in FIG. 1 wherein broken lines indicate light-sensitive materials containing the compound of formula (I) and solid lines indicate those not containing the compound of formula (I) according to the present invention.

FIG. 1 indicates that in accordance with the method of the invention, even though the processing period is short, the desired photographic characteristics can be obtained, i.e., the dependence on processing period within from 0.5 to 3.5 minutes is markedly reduced, and with a processing period of 1 minute or less, the color density is sufficiently high and the desired photographic properties can be obtained. (In accordance with the method of the invention, since changes in photographic properties between 0.5 minute and 1 minute are markedly reduced, the desired photographic properties can be obtained even within such a short period range as long as the fluctuation of processing time can be reduced within a period of ± several seconds.)

EXAMPLE 2

Light-sensitive materials were prepared in the same manner as in Example 1 except that the magenta coupler was changed to Magenta Couplers (2-A) and (2-B), respectively.

Magenta Coupler (2-A)

1-(2′,4′,6′-Trichlorophenyl)-3-[3″-(2‴,4‴-di-tert-amylphenoxyacetamido)benzamido]-4-phenylmercapto-5-pyrazolone (silver: 0.14 g/m$^2$; coupler $5.8\times10^{-4}$ mol/m²; oil for coupler (tricresyl phosphate): 0.35 g/m²; Magenta Coupler (M-2) of the invention)

Magenta Coupler (2-B)

1-(2',4',6'-Trichlorophenyl)-3-[3''-(2''',4'''-di-tert-amylphenoxyacetamido)benzamido]-4-(4'-chlorocinnamoyloxy)-5-pyrazolone (silver: 0.14 g/m²; coupler: $5.8\times10^{-4}$ mol/m²; oil for coupler (tricresyl phosphate): 0.35 g/m²; Compound described in Japanese Patent Application (OPI) No. 52422/78)

Each light-sensitive material was exposed to light through an optical wedge and processed in the same manner as in Example 1.

The maximum density at each processing time was measured, and the results are shown in Table 1.

TABLE 1

| Processing Time (min) | Coupler | Magenta Coupler 2-A Compound I-4 — | 2-A Compound I-4 100 mg/m² | 2-B Compound I-4 — | 2-B Compound I-4 100 mg/m² |
|---|---|---|---|---|---|
| 0.25 | Y | 0.50 | 1.50. | 0.45 | 1.00 |
| | M | 0.65 | 2.00 | 0.30 | 0.35 |
| | C | 1.85 | 2.30 | 1.65 | 1.70 |
| 0.5 | Y | 1.20 | 2.00 | 1.00 | 1.45 |
| | M | 2.10 | 2.35 | 1.00 | 1.05 |
| | C | 2.50 | 2.50 | 2.10 | 2.15 |
| 0.75 | Y | 1.75 | 2.00 | 1.50 | 1.80 |
| | M | 2.40 | 2.40 | 1.65 | 1.70 |
| | C | 2.55 | 2.50 | 2.40 | 2.40 |

When Magenta Coupler (2-A) is used, as in the case of Example 1, the effects of Compound I-4 can be obtained, and even though the processing period is less than 1 minute, the dependence on processing time is reduced and the color density is sufficiently high. On the other hand, when Magenta Coupler (2-B) is used, the effects of the coupler on magenta coloration is very small, the color density when processed for a period of less than 1 minute is insufficient, and thus the effects of the invention cannot be obtained.

EXAMPLE 3

A series of light-sensitive materials were prepared in the same manner as in Example 1 except that (1) 7.5 mg/m² of Compound I-1 was used, (2) 75 mg/m² of Compound I-1 was used, (3) 10 mg/m² of Compound I-4 was used, or (4) a compound of formula (I) was not used.

Each light-sensitive material was exposed to light through an optical wedge and processed in the same manner as in Example 1.

The maximum density at processing periods of 0.25 minute and 0.5 minute were measured, and the results are shown in Table 2.

TABLE 2

| Processing Time (min) | Coupler | (1) Compound I-1 7.5 mg/m² | (2) Compound I-1 75 mg/m² | (3) Compound I-4 10 mg/m² | (4) No Compound of Formula (I) |
|---|---|---|---|---|---|
| 0.25 | Y | 0.10 | 0.50 | 0.10 | 0.10 |
| | M | 0.25 | 0.65 | 0.25 | 0.20 |
| | C | 0.55 | 1.00 | 0.55 | 0.20 |
| 0.5 | Y | 0.70 | 1.10 | 0.60 | 0.40 |
| | M | 1.20 | 1.70 | 1.30 | 0.70 |
| | C | 1.90 | 1.75 | 1.85 | 1.25 |

As can be seen from Table 2, with the light-sensitive material of the invention, the development density is obtained for each of yellow, magenta and cyan in very short periods of time as compared with Comparative Sample.

EXAMPLE 4

An ethanol solution of Compound I-4 of the invention and Yellow Coupler (Y-3) dissolved in tricresyl phosphate were emulsified in a silver chlorobromide emulsion (silver bromide, 80 mol%), and coated on a paper support which had been laminated with polyethylene on both sides thereof and had a subbing layer.

| | |
|---|---|
| Amount of silver coated | 0.40 g/m² |
| Amount of coupler | $8\times10^{-4}$ mol/m² |
| Oil for coupler | 0.3 g/m² |
| Amount of tricresyl phosphate coated | 1.15 g/m² |
| Compound I-1 | 75 mg/m² |

In addition to the above prepared light-sensitive material, two light-sensitive materials were prepared in the same manner as above except that (1) 100 mg/m² of Compound I-4 was used, and (2) a compound of formula (I) was not used.

Each light-sensitive material was exposed to light through an optical wedge and processed in the same manner as in Example 1.

After the processing, the yellow reflection density was measured with a Macbeth densitometer. The maximum density at a processing period of 0.25 min, 0.5 min, or 1 min was measured, and the results are shown in Table 3.

TABLE 3

| Processing Time (min) | Compound I-1 75 mg/m² | Compound I-4 100 mg/m² | No Compound of Formula (I) |
|---|---|---|---|
| 0.25 | 1.20 | 1.40 | 0.50 |
| 0.5 | 1.65 | 1.90 | 1.10 |
| 1 | 2.15 | 2.20 | 2.00 |

When the compound of formula (I) of the invention was incorporated, the maximum density at a short processing period of 1 minute or less was higher than that for the Comparative Sample.

Recently, more rapid processing has been increasingly required for improved efficiency. Thus, the method of the invention is very useful in that it enables obtainment of the desired photographic characteristics in a very short processing time, i.e., 1 minute or less.

EXAMPLE 5

In the same manner as in Example 1, Compound I-1 or Compound I-4 (as indicated below) of the invention was incorporated only in the yellow layer, or were not incorporated, and the thus prepared light-sensitive material was exposed to light through an optical wedge, processed, and measured in the density. The results are shown in Table 4.

TABLE 4

| Processing Time (min) | Coupler | Compound I-1 7.5 mg/m² | Compound I-1 75 mg/m² | Compound I-4 10 mg/m² | Compound I-4 100 mg/m² | No Compound of Formula (I) |
|---|---|---|---|---|---|---|
| 0.25 | Y | 0.20 | 0.70 | 0.20 | 0.75 | 0.10 |
| | M | 0.45 | 1.10 | 0.50 | 1.30 | 0.20 |
| | C | 0.75 | 1.35 | 0.90 | 1.40 | 0.30 |
| 0.5 | Y | 0.70 | 1.15 | 0.75 | 1.40 | 0.50 |
| | M | 1.50 | 2.00 | 1.60 | 2.10 | 1.00 |
| | C | 2.10 | 2.05 | 2.00 | 1.80 | 1.67 |

When the compound of formula (I) was incorporated only in the yellow layer, the maximum density for the magenta and cyan was increased compared with that when the compound is not incorporated.

EXAMPLE 6

The light-sensitive materials prepared in Example 5 were exposed to light in the same manner as in Example 1. The thus-exposed light-sensitive materials were processed with Color Developer A, B, C or D, and thereafter, were fixed and washed with water in the same manner as in Example 1. The maximum density for each layer was measured, and the results are shown in Table 5.

Color Developer B (as described in British Pat. No. 1,032,925) and Color Developer A were composed of the ingredients as set forth below:

| | Color Developer B | Color Developer A |
|---|---|---|
| Sodium tetrapolyphosphate | 1.0 g | 1.0 g |
| 6-Nitrobenzimidazole | 30 mg | 30 mg |
| N,N—Diethyl-p-phenylenediamine | 2.0 g | 2.0 g |
| Anhydrous sodium sulfite | 40.0 g | 40.0 g |
| Compound I-1 of the invention | 2.0 g | — |
| Anhydrous sodium carbonate | 20.0 g | 20.0 g |
| Potassium bromide | 1.5 g | 1.5 g |
| Sodium hydroxide | 1.2 g | 1.2 g |
| Water to make 1 liter | | |

Color Developer C was the same as used in Example 1. Color Developer D was prepared by adding 2.0 g/l of Compound I-1 of the invention to Color Developer C.

TABLE 5

| Processing Time (min) | Coupler | Color Developer A Material Containing 75 mg/m² of Compound I-1 | Color Developer B Material Containing No Compound of Formula (I) | Color Developer C Material Containing 75 mg/m² of Compound I-1 | Color Developer D Material Containing No Compound of Formula (I) |
|---|---|---|---|---|---|
| 0.25 | Y | 0.80 | 0.72 | 0.85 | 0.55 |
| | M | 1.50 | 0.70 | 1.35 | 0.70 |
| | C | 2.30 | 1.10 | 1.55 | 0.40 |
| 0.5 | Y | 1.50 | 1.20 | 1.40 | 0.70 |
| | M | 2.25 | 1.15 | 2.10 | 0.70 |
| | C | 2.35 | 1.15 | 2.20 | 0.45 |
| 1 | Y | 1.95 | 1.40 | 2.15 | 0.90 |
| | M | 2.30 | 1.30 | 2.25 | 0.75 |
| | C | 2.40 | 1.20 | 2.20 | 0.45 |
| 3.5 | Y | 2.45 | 1.65 | 2.45 | 0.95 |
| | M | 2.50 | 1.40 | 2.40 | 0.80 |
| | C | 2.45 | 1.35 | 2.35 | 0.50 |

By comparison of the light-sensitive material processed with Color Developer A or B with the light-sensitive material processed with Color Developer C or C, it can be seen that the light-sensitive material processed with Color Developer A or C is markedly accelerated in color development. On the other hand, with the light-sensitive material processed with Color Developer B or D, a deterioration (oxidation) with time of the color developing agent proceeds rapidly, and the objects of the invention cannot be attained.

The method of the invention produces significant effects that could not be obtained by the method described in British Pat. No. 1,032,925.

EXAMPLE 7

Compounds I-2, I-3, I-7, I-8, I-9, I-10, I-22, I-23, I-28 and I-29 were each used to prepare a light-sensitive materials as in Example 1, except for substitution of the foregoing compounds for Compound I-4, and then each material was exposed and processed in the same manner as in Example 1.

The photographic characteristics of each light-sensitive material was measured, and was found to have preferred characteristics as in the case of Example 1.

While the invention has been described in detail and with reference to specific embodiments thereof, it will be apparent to one skilled in the art that various changes and modifications can be made therein without departing from the spirit and scope thereof.

What is claimed is:

1. A method for forming a color image by the reaction of the oxidation product of a color developer with a color coupler upon color development, comprising color developing a color photographic silver halide light-sensitive material containing at least one compound represented by formula (I)

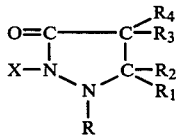

(I)

wherein X is a hydrogen atom or an acetyl group, R is an aryl group, and each of $R_1$, $R_2$, $R_3$, and $R_4$ is a hydrogen atom, an alkyl group, or an aryl group, using a color developer containing a p-phenylenediamine based color developing agent selected from the group consisting of 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, and 4-amino-3-methyl-N-ethyl-N-β-methoxyethylaniline and without performing black-and-white development.

2. A method as in claim 1, wherein the color developer contains from 1 to 12 g/liter of the p-phenylenediamine-based color developing agent.

3. A method as in claim 1 or 2, wherein each of $R_1$, $R_2$, $R_3$, and $R_4$ is a hydrogen atom or an unsubstituted or substituted alkyl group containing from 1 to 10 carbon atoms.

4. A method as in claim 1 or 2, wherein each of $R_1$, $R_2$, $R_3$, and $R_4$ is a hydrogen atom, a methyl group, or a hydroxymethyl group.

5. A method as in claim 1 or 2, wherein the amount of the compound represented by formula (I) incorporated in the light-sensitive material is from 0.001 to 1 mol per mol of silver halide.

6. A method as in claim 1 or 2, wherein the amount of the compound represented by formula (I) incorporated in the light-sensitive material is from 0.005 to 0.5 mol per mol of silver halide.

7. A method as in claim 1, consisting essentially of the steps of:

(a) color developing;

(b) bleaching; and (c) fixing.

8. A method as in claim 1, wherein said color coupler is represented by the general formula (II)

A—Y (II)

wherein A is a group containing an active coupling site for a 5-pyrazolone coupler or a pyrazolobenzimidazole coupler; and Y is a hydrogen atom,

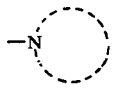

or —S—$R_5$, wherein $R_5$ is selected from the group consisting of a substituted or unsubstituted straight or branched chain alkyl group containing from 1 to 32 carbon atoms, a substituted or unsubstituted aryl group containing from 6 to 36 carbon atoms, or a heterocyclic group.

9. A method as in claim 1, wherein said color photographic silver halide light-sensitive material comprises a support having thereon a silver halide emulsion layer containing a color coupler and a hydrophilic colloid layer.

10. A method as in claim 8, wherein $R_5$ is an substituted or unsubstituted alkyl group containing from 1 to 22 carbon atoms.

11. A method as in claim 8, wherein $R_5$ is a phenyl group or a naphthyl group.

* * * * *